US007011585B1

(12) United States Patent
Valenzuela

(10) Patent No.: US 7,011,585 B1
(45) Date of Patent: Mar. 14, 2006

(54) GUARDRAIL AND POCKET PROTECTOR

(76) Inventor: Jorge M. Valenzuela, 25207 S. 195th St., Queen Creek, AZ (US) 85242

( * ) Notice: Subject to any disclaimer, the term of this patent is extended or adjusted under 35 U.S.C. 154(b) by 0 days.

(21) Appl. No.: 10/831,678

(22) Filed: Apr. 23, 2004

(51) Int. Cl.
*A63D 15/06* (2006.01)

(52) U.S. Cl. ..... 473/31; 473/32

(58) Field of Classification Search ..... 473/1, 473/6, 7, 8, 11, 13, 28, 31, 32
See application file for complete search history.

(56) References Cited

U.S. PATENT DOCUMENTS 540,405 A * 6/1895 Rommel ..... 473/8
1,323,516 A * 12/1919 Acland ..... 473/32
3,733,072 A * 5/1973 Nielsen ..... 473/28
3,811,673 A * 5/1974 Baker ..... 473/31
4,508,338 A * 4/1985 Kremski ..... 473/32
5,720,666 A * 2/1998 Arculeo ..... 473/31

* cited by examiner

*Primary Examiner*—Mitra Aryanpour

(74) *Attorney, Agent, or Firm*—Lawrence J. Gibney

(57) ABSTRACT

In order to protect the appearance of and extend the life of a pool table, this protective device has been invented. It will be constructed from a lightweight yet durable material such as vinyl or cloth and be pressed, snapped or glued to the sides of the pool table. Separate devices will be used to protect the pockets of the pool table.

7 Claims, 4 Drawing Sheets

GUARDRAIL AND POCKET PROTECTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to guardrail and pocket guards for pool tables. Specifically it involves protection for the guardrails and pockets of a billiard table to extend the life of a pool table.

B. Prior Art

There are other protective devices for pool tables and representative examples are Tsui, U.S. Pat. No. 6,036,155, McCall, U.S. Pat. No. 5,639,072 and Patterson, U.S. Pat. No. 5,878,455.

The Tsui patent is a corner bumper for use on an immovable object such as on a car to protect a fixed object such as a building. The McCall patent is for furniture edges and the Patterson is a corner guard for mattress.

The prior patents have similar shapes and functions i.e. to protect a surface, but are being used in totally different use. These different uses do not contemplate use with a pool or billiard tables.

BRIEF SUMMARY OF THE INVENTION

The game of pool is played on a pool or billiard table. The table is rectangular in shape and has pockets on the corners and the middle of the sides of the table for a total of six pockets. A pool table is a major expense and at times can also serve as a piece of furniture. Therefore, it is important for the owner to maintain the appearance of the pool table.

This device protects the guardrails and pockets and is inserted over each side by laying or pressing them on the sides, depending on the type of pool table involved. Each protective side would lie flat over the side of the table and have a piece, which would be shaped to conform to the sides of the pool table.

In addition to protecting the rails of the pool table, the device will also have parts to protect the pockets and which conform to the shape of the pockets.

When the device is inserted on the pool table it increases the longevity of the pool table and maintains its appearance as long as possible. It will protect the top surfaces from scratches and nicks.

The pieces of this invention would be easily removable if no longer desired. The pieces of this device would be designed from a variety of materials and in particular vinyl or cloth. The choice of material would seek to make installation as trouble free as possible and be as durable as possible while maintaining the aesthetics of the pool table.

DETAILED DESCRIPTION OF THE EMBODIMENTS

Figure 2:
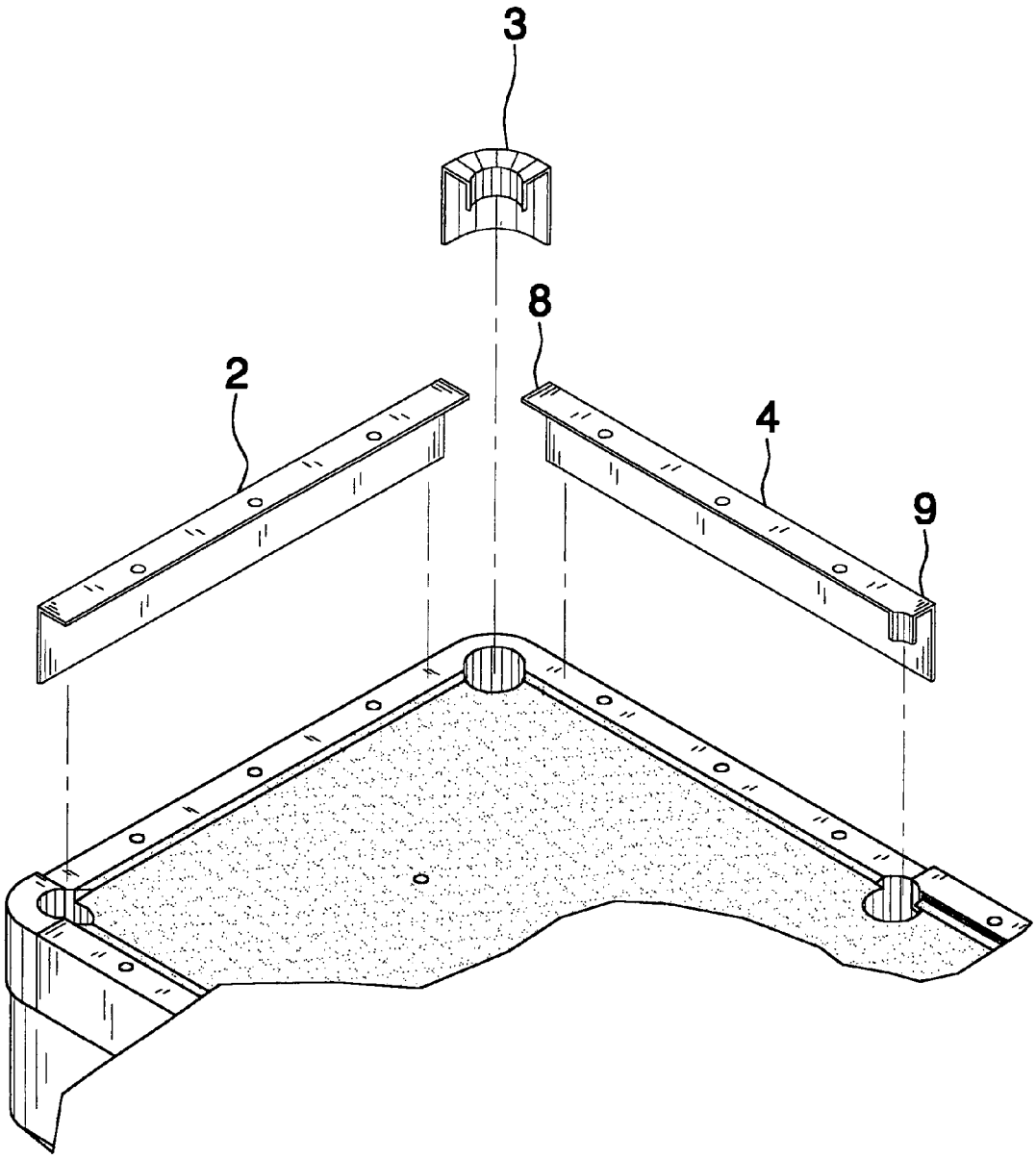
FIG. 2 is a partial exploded view of a portion of the pool table showing the parts of the device as they would be inserted over the pool table.

The specific parts of this device 6 include the following: guardrails 2, side members 4 and pocket pieces 3. FIG. 2.

Figure 1:
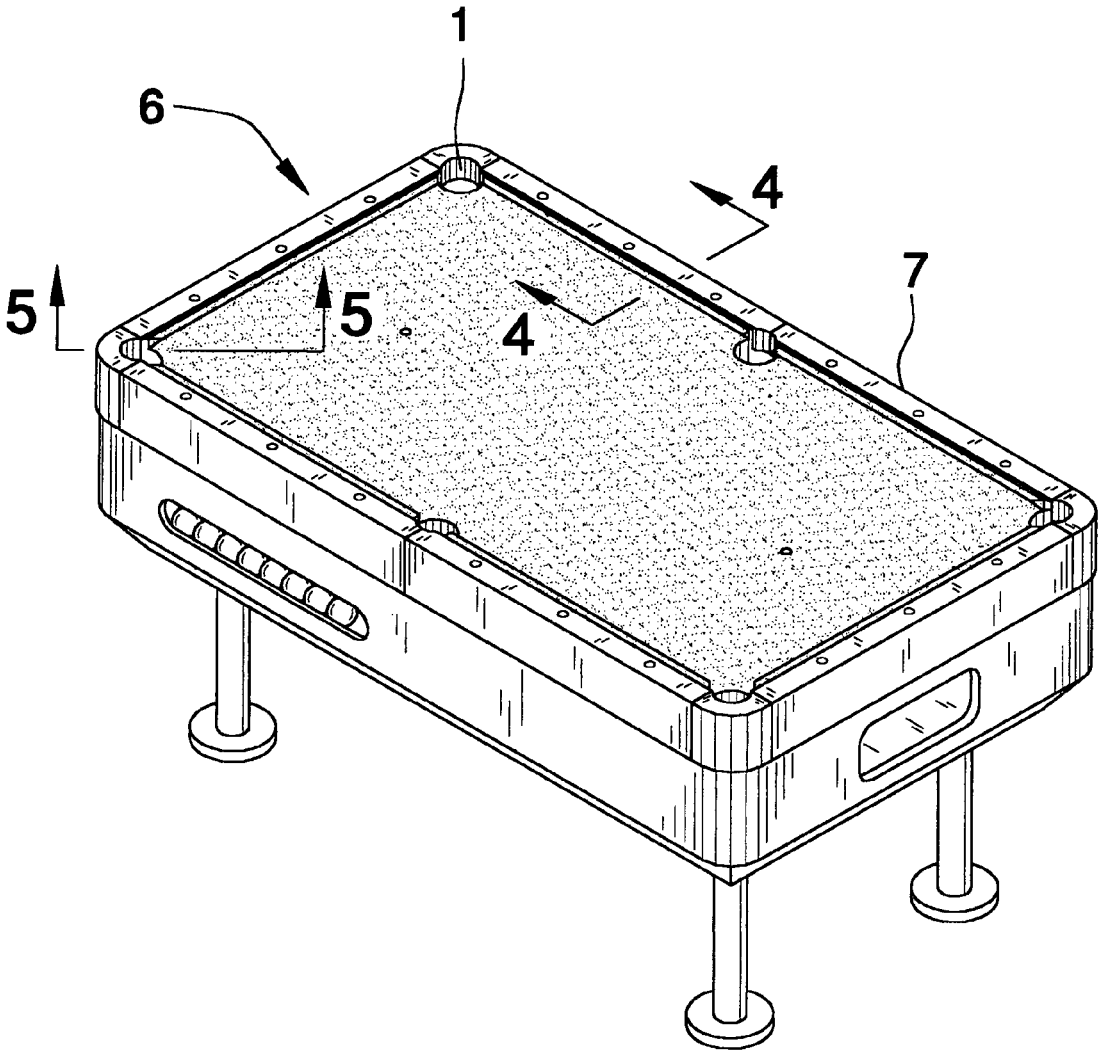
FIG. 1 is perspective view of a pool table with the parts of the device inserted.

FIG. 1 shows the layout of the typical pool table with the parts of the device 6 installed. The protective parts of the device 6 would include pieces that would cover all the top surfaces of the pool table and the pockets 1 of the pool table.

A standard pool table is rectangular in shape and has six pockets 1. The frame for the typical pool table includes a set of legs or other means to support the table, a flat surface on which the game is played, raised surfaces above the flat surface and pockets, which are positioned on the flat surface and formed by the raised portions of the table. Four of the pockets 1 are on the corners and two are in the middle of the sides. Felt usually covers the top surface of the pool table.

Like any rectangle there are two short sides of the table and two longer sides. Two of the pockets are located in the middle of the long side respectively. Although FIG. 1 depicts the basic shape of a pool table the design of the pool table itself is not being claimed as part of this invention.

This device is comprised of pieces, which cover the two short sides and two long sides of the pool table in order to protect the finish of the original pool table. The pieces of this device are designed to be removable without affecting how the game of pool is played or the basic structure of a pool table.

Figure 3:
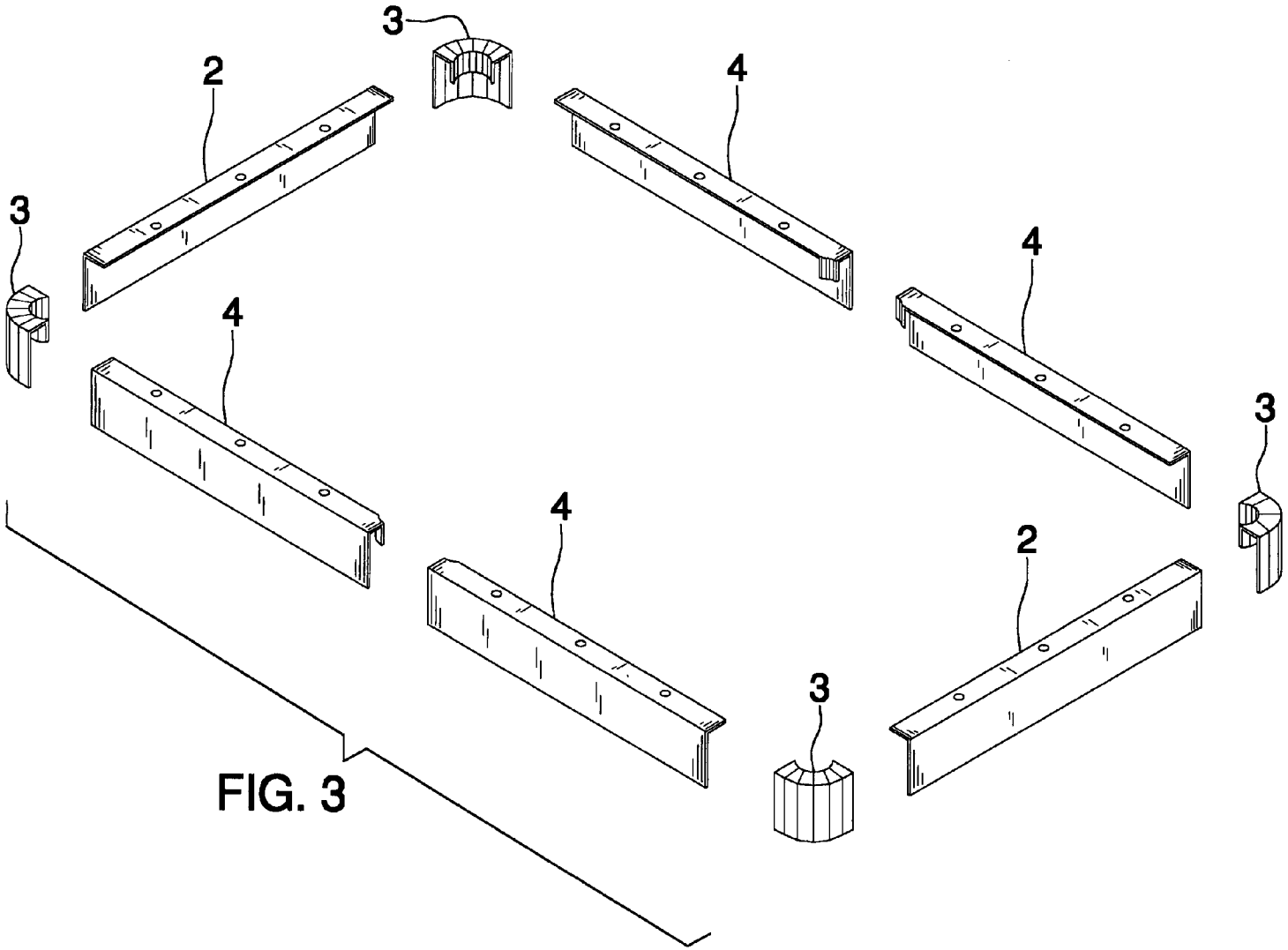
FIG. 3 is a view of a complete set of the pieces to be inserted over the standard pool table.

FIG. 1 shows the device 6 installed over guardrails 2 and pockets 1 of the pool table. FIGS. 1 and 3 show all parts of the device.

FIG. 2 depicts a partial exploded view of the parts of this device. The guardrail 2 that is used on one of the short sides lies flat against the top surfaces and extends from one edge of a pocket 1 to the other edge of the pocket on the opposite side. FIGS. 1, 2 The guardrail 2 is in the general shape of a upside down "L" for pool tables and may have a variety of different shapes depending on the specific type of pool table.

As shown in FIG. 2, one side of the upside down "L" is placed on the flat surface of the pool table and the other is placed on the surface below the tabletop. Both surfaces are inserted over the top surface of the pool table.

The guardrail 2 pieces are attached to the respective sides by a means of attachment, which may include an adhesive strip, glue, or snaps. Other means of attachments may also be used depending on the type of pool table.

In addition to the guardrail 2 are side members 4, which cover the area on the long side of the table. Each side member is specifically tailored to fit along the longitudinal or long sides of the pool table. This side member 4 has a first side 8 and second side 9. FIG. 2 The first side 8 abuts one edge of the pocket piece 3 and the second side abuts one edge of the pocket piece 3 in the middle of the table. The second side 9 of this side member 4 is shaped to fit in the pocket and conform to the shape of the pocket. FIG. 2 The side members 4 are also in the shape of an upside down "L" and are attached in the same manner as the guardrail 2, such as with an adhesive strip, glue, snaps or pressing the device on the side of the pool table. All parts of the device would be made from the same material to maintain uniform appearance and the aesthetic quality of the table.

A pocket piece 3 is used to protect the pocket 1 and this pocket piece 3 is manufactured in the shape of the pocket. FIGS. 1, 2 This pocket piece 3 is inserted into the pocket 1 and abuts the respective edges of the guardrail 2 and first side 8 of the side members 4, as shown in FIG. 2. The pocket piece 3 slips over the outer edge of the pool table to produce a tight fit.

The method of attachment that is contemplated can include VELCRO, straps, snaps or pressing the piece onto the table. The specific means of attachment may vary depending on the contours of the pool table.

Figure 4:
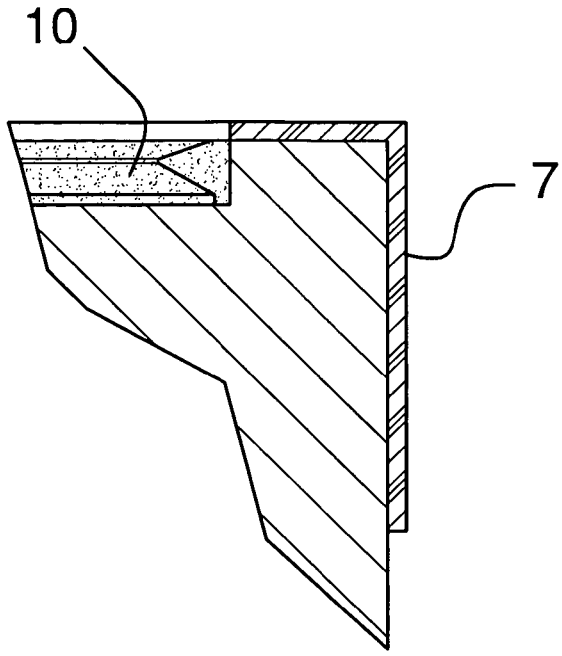
FIG. 4 is a partial cross sectional view of the guardrail along line 4—4 on FIG. 1.
Figure 5:
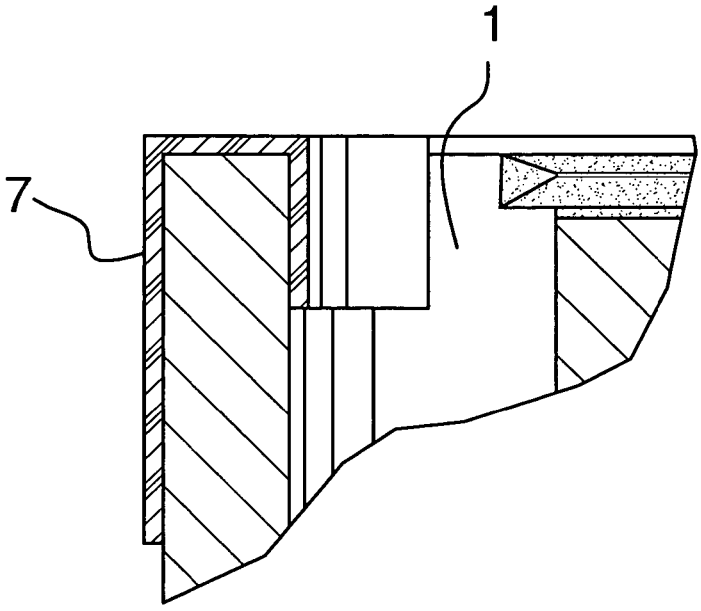
FIG. 5 is a partial cross sectional view of the billiard pocket protector along line 5—5 on FIG. 1.

FIGS. 4 and 5 depict a partial cross section of the guardrail 2 and pocket piece. A piece of foam or other cushioning material 10 is placed under the top surface of the guardrail 2 to further protect the pool table surface.

FIG. 5 shows the partial cross section of the pocket protector showing the pocket 1. The pocket protector would be inserted over the surface of the pocket 1 for a tight fit.

It is contemplated that the parts of the device would be made from durable material.

While the embodiments of the invention have been disclosed, Those may make certain modifications skilled in the art to modify the invention without departing from the spirit of the invention.

The inventor claims:

1. A device for protecting the top surfaces and pockets of a pool table, the device is used in combination with an existing pool table, the device comprising the following protective parts:

a. guardrails;

b. side members;

c. pocket pieces; and means for attaching the guardrails, side members and pocket pieces to the top surface of the pool table;

wherein the guardrails, side members and pocket pieces of the device are installed over the existing frame of the pool table;

said guardrails, side members and pocket pieces of the device are designed for removable attachment over the frame of the pool table without affecting the structure of the pool table;

wherein the side members each have a first side and a second side;

wherein the first side of each of the side members abuts the edge of one of the pocket pieces;

wherein the second side of each of the side members abuts the edge of an adjacent side member; and wherein the guardrails are removably attached to the side of the pool table.

2. The device as described in claim 1, wherein the means for attachment is by pressing the protective parts on the side of the pool table.

3. The device as described in claim 1, wherein the means for attachment is an adhesive strip.

4. The device as described in claim 1, wherein the means for attachment is glue.

5. The device as described in claim 1, wherein the means for attachment are snaps.

6. The device as described in claim 1, wherein the pocket pieces are shaped to conform to the shape of the table pockets.

7. The device as described in claim 1, further including a piece of foam for inserting under the top surface of the guardrails to further protect the pool table surface.

* * * * *